US007819074B2

(12) United States Patent
Chen

(10) Patent No.: US 7,819,074 B2
(45) **Date of Patent: *Oct. 26, 2010**

(54) SELF-PROPELLED HYDROFOIL DEVICE WITH FLEXIBLE STEERING ASSEMBLY

(76) Inventor: Shane Chen, 1821 NW. Eight Ave., Camas, WA (US) 98607

( * ) Notice: Subject to any disclaimer, the term of this patent is extended or adjusted under 35 U.S.C. 154(b) by 0 days.

This patent is subject to a terminal disclaimer.

(21) Appl. No.: 12/313,541

(22) Filed: Nov. 20, 2008

(65) Prior Publication Data

US 2009/0120346 A1 May 14, 2009

Related U.S. Application Data

(63) Continuation-in-part of application No. 11/593,141, filed on Nov. 3, 2006, which is a continuation-in-part of application No. 11/375,538, filed on Mar. 13, 2006, now Pat. No. 7,434,530, which is a continuation-in-part of application No. 10/657,664, filed on Sep. 7, 2003, now Pat. No. 7,021,232.

(51) Int. Cl.
*B63B 1/24* (2006.01)

(52) U.S. Cl. ..... 114/274; 440/21

(58) Field of Classification Search ..... 440/21–31; 114/274–282

See application file for complete search history.

(56) References Cited

U.S. PATENT DOCUMENTS 6,099,369 A * 8/2000 Puzey ..... 440/21
7,021,232 B2 * 4/2006 Chen ..... 114/274
7,434,530 B2 * 10/2008 Chen ..... 114/274

* cited by examiner

*Primary Examiner*—Ed Swinehart
(74) *Attorney, Agent, or Firm*—Steven J. Adamson

(57) ABSTRACT

A self-propelled hydrofoil device that includes a front foil, a rear foil, a user platform, a steering shaft and a frame that couples these components. The steering shaft preferably has a top section and a lower section, the top section being substantially rigid and the lower section being flexible relative to the top section. The top and lower sections may be formed of different materials or may be formed of the same material, integrally or non-integrally. The top and lower sections are preferably offset by an angle, α, to achieve more ready bending of the lower section.

20 Claims, 1 Drawing Sheet

SELF-PROPELLED HYDROFOIL DEVICE WITH FLEXIBLE STEERING ASSEMBLY

CROSS REFERENCE TO RELATED APPLICATIONS

This application is a continuation-in-part of U.S. patent application Ser. No. 11/593,141, filed Nov. 3, 2006, entitled Self-Propelled Hydrofoil Device with Leverage-Based Control of Drive Foil, now pending, which is a continuation-in-part of U.S. patent application Ser. No. 11/375,538, filed Mar. 13, 2006, and entitled "Collapsible Self Propelled Hydrofoil Device," which issued on Oct. 14, 2008, as U.S. Pat. No. 7,434,530. U.S. patent application Ser. No. 11/375,538 is a continuation-in-part of U.S. patent application Ser. No. 10/657,664, filed Sep. 7, 2003, and entitled "Self Propelled Hydrofoil Device" by the same inventor as above, now issued as U.S. Pat. No. 7,021,232. These documents are hereby incorporated by reference.

FIELD OF THE INVENTION

The present invention relates to a long-lived self-propelled hydrofoil device with a flexible steering shaft. The present invention also relates to a self-propelled hydrofoil device with enhanced flotation.

BACKGROUND OF THE INVENTION

Self-propelled hydrofoil devices are known in the art and include those disclosed in U.S. Pat. No. 7,021,232 to Chen (the inventor herein), which is hereby incorporated by reference, and the "Trampofoil" device disclosed in Swedish Design Patent no. 98-0088.

While these patents further the self-propelled hydrofoil art, they are disadvantageous for one or more reasons. For example, the device of Chen '232 has a bi-partite steering structure in which the upper and lower parts of the steering shaft are joined in a spring-biased pivoting arrangement. This arrangement is disadvantageous in that the spring mechanism and related coupling components constitute additional mechanical devices that increase the possibility of mechanical failure. Furthermore, they add to the cost and complexity of the steering shaft and its manufacturing process because they are additional parts that need to be sources and assembled within it.

A need exists for a self-propelled hydrofoil device having a steering shaft with a limited number of components (thereby increasing its useful life) that provides sufficient flexibility for effective movement of the drive foil yet with sufficient stability for steering.

The Trampofoil device is disadvantageous, among other reasons, in that the steering shaft, along its length from the handle to the front foil, is formed of a flexible material. While the flexibility of this shaft is beneficial in achieving the undulating tilt of the drive foil that serves to drive the hydrofoil device, the flexibility is too great laterally and causes the hydrofoil device to be both difficult to steer and unstable. Furthermore, the steering shaft of the Trampofoil is substantially linear and does not provide a sufficient angle between the top section and bottom sections to achieve ready bending of the steering shaft. A need thus exists for a steering shaft that is flexible for drive foil operation, yet sufficient stable for steering. A need also exists for such a steering shaft that has a sufficient angle between the top and bottom sections so that force from a downward thrust on the top section is transferred to the bottom section in a manner that readily bends the lower section to assist in drive foil positioning.

Prior art self-propelled hydrofoil devices are also disadvantageous in that they have limited buoyancy, which makes starting them difficult and increases their drag when pulled through water (for example, to pull them back to a dock for starting). Their buoyancy is limited to the scant amount of air trapped within the typically aluminum frame, foil, and other components.

A need exists for a self-propelled hydrofoil device having a steering shaft with a limited number of components (thereby increasing its useful life) that provides sufficient flexibility for effective movement of the drive foil yet with sufficient stability for steering.

A need also exists for a self-propelled hydrofoil device with greater buoyancy, to enhance restart and reduce drag, among other reasons.

SUMMARY OF THE INVENTION

Accordingly, it is an object of the present invention to provide a self-propelled hydrofoil device having a steering shaft with fewer moving parts yet which provides effective drive foil movement and stability for steering.

It is another object of the present invention to provide a self-propelled hydrofoil device having a steering shaft with a top section that is substantial rigid and a bottom section that is flexible relative- to the top section.

It is also an object of the present invention to provide a self-propelled hydrofoil device having enhanced buoyancy.

In one embodiment, the present invention includes a front foil, a rear foil, a user platform, a steering shaft and a frame that couples these components. The steering shaft may have a top section and a lower section, the top section being substantially rigid and the lower section being flexible relative to the top section. The top section and lower section may be formed of different materials or of the same material. If formed of the same material, they may be formed integrally or non-integrally. The top and lower sections may define axes that are offset by an angle, $\alpha$, to achieve more ready bending of the lower section. This angle may range from 5-60 degrees or from 10-40 degrees or be otherwise configured.

These and related objects of the present invention are achieved by use of a self-propelled hydrofoil device with flexible steering assembly and enhanced buoyancy as described herein.

The attainment of the foregoing and related advantages and features of the invention should be more readily apparent to those skilled in the art, after review of the following more detailed description of the invention taken together with the drawings.

DETAILED DESCRIPTION

Figure 1:
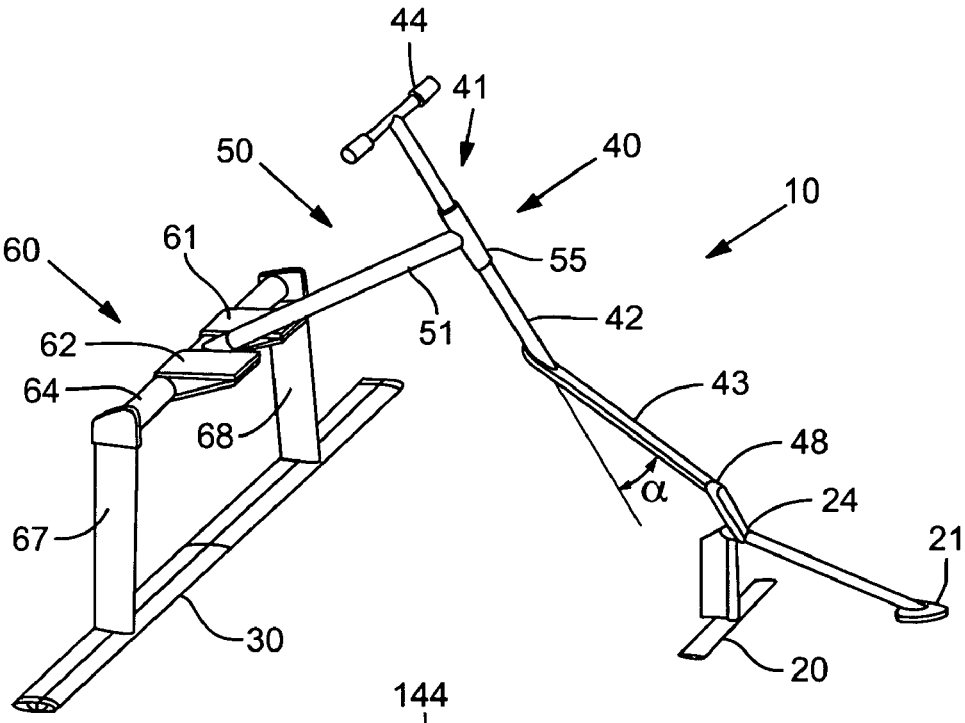
FIG. 1 is a perspective view of a self-propelled hydrofoil device having a steering shaft with a lower section that is more flexible than its top section in accordance with the present invention.

Referring to FIG. 1, a perspective view of a self-propelled hydrofoil device 10 in accordance with the present invention is shown.

Device 10 may include a front foil 20, a rear foil 30, a steering structure 40, a support frame structure 50 and a user platform 60, among other components. The steering structure 40 preferably includes a steering shaft 41 having a bi-partite arrangement as discussed in more detail below. The steering shaft preferably includes a top section 42 and a bottom section 43.

The front foil 20 may be arranged in a "canard" configuration 22 with a water surface finding foil or spoon 21. In the canard configuration, foil 20 and spoon 21 are coupled in a fixed relationship and are in turn coupled at pivot 24 to that lower end of steering shaft 41. Canard structures for locking to the water surface are known in the art.

The opposite or top end of steering shaft 41 may include a handle bar 44 or other suitable steering/control handle. Frame structure 50 couples the steering shaft 41 to the user platform 60. Frame structure 50 may include a support shaft 51 that may be comprised of one or more members. Only one is shown in FIG. 1, yet another could, for example, descend from member 51 to a lower region of top section 42.

A steering shaft collar or cylindrical housing 55 may couple the steering shaft 41 to the support shaft 51. Collar 55 may include internal bushings or the like for securely holding steering shaft 41 in a manner that permits user rotation of the steering shaft to achieve turning. It should be recognized that other methods of achieving turning can be used without deviating from the present invention.

The user platform may include left and right foot placement sections 61,62, a joint member 63 for coupling to support shaft 51 and a frame member 64 for coupling to the rear or drive foil 30. A pair of vertical members 67,68 or another suitable structure may mount the rear foil 30 below the user platform.

Referring more specifically to steering shaft 41, top section 42 is substantially rigid while lower section 43 is flexible relative to the top section.

The lower section is preferably inclined forward to a greater degree than the top section. In this configuration, the lower section bends in response to the downward thrust of a user more readily than if the top and bottom sections were inclined to substantially the same degree. While the top and bottom sections need not be linear (in which case a best-fit linear approximation may be used), if they are substantially linear (as shown), then they have axes and the angle, $\alpha$, between those axes is preferably in a range of 5-60 degrees and may further be between 10-50 degrees.

The flexibility inherent in the lower section 43 provides a pivoting relationship between the front foil and the drive foil, permitting the drive foil to descend in response to a user's thrust (to achieve a drive inclination) yet move back upward to a coast (pre-thrust) position.

The top section and the lower section may be made of two different materials. For example, the top section may be made of aluminum or another metal (formed to be substantially rigid) and the bottom section may be made of fiberglass or the like that is formed to be relatively flexible, yet suitably strong to provide adequate frame strength/support.

If the two sections are formed of different materials, then lower section 43 may be glued, bolted and/or press fit or otherwise securely mounted to top section 42.

It should be recognized, however, that the top section and bottom section may be formed of the same material, yet configured to have a substantially rigid top section and a relatively flexible bottom section, the bottom section inclined forward to a greater degree than the top section. This may be achieved, for example, by forming the steering shaft out of a material, such a steel, fiberglass or carbon fiber, that can be flexible or rigid depending on its thickness and/or the manner in which it is made. For example, steering shaft 41 could be formed of fiberglass or carbon fiber, or a non-corrosive metal or the like, with the top section being thicker or reinforced to be substantially rigid, while the lower section is thinner and more flexible. In the present invention, the lower section is flexible enough to successfully accommodate a drive thrust yet rigid enough to provide adequate frame support and steering stability.

A mounting member 48 may be connected to lower section 43 and couple the steering shaft 41 to the canard 22.

Figure 2:
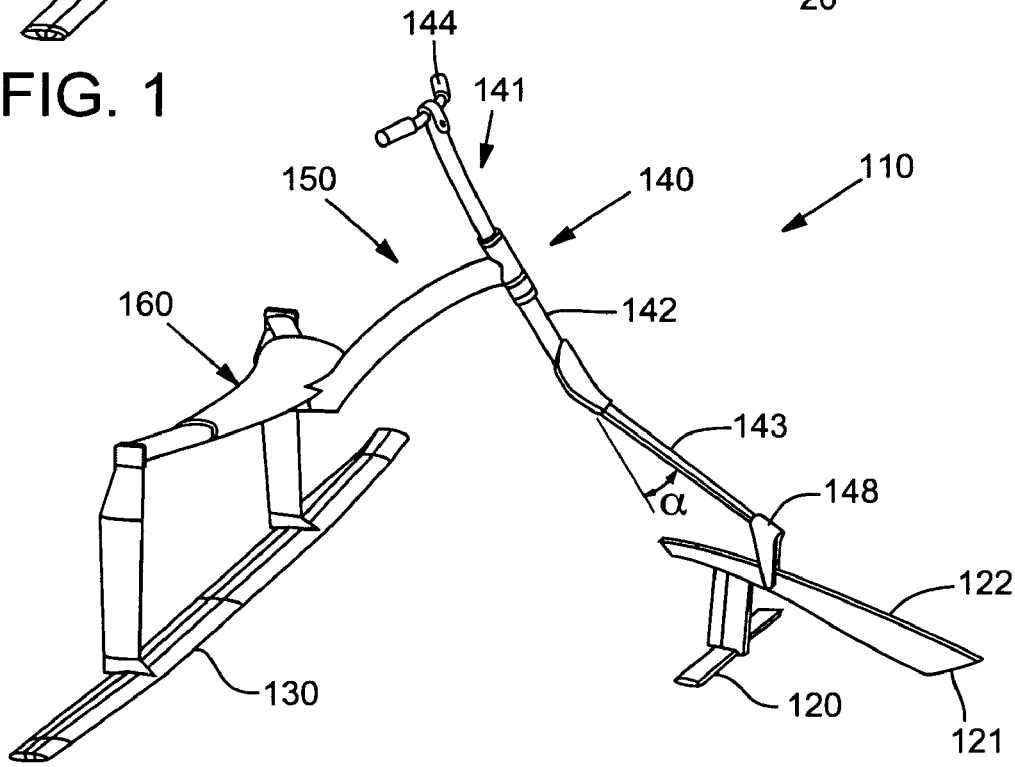
FIG. 2 is a perspective view of another embodiment of a self-propelled hydrofoil device having a steering shaft with a flexible lower section in accordance with the present invention.

Referring to FIG. 2, a perspective view of another embodiment of a self-propelled hydrofoil device 110 in accordance with the present invention is shown. This device includes a front foil 120, rear foil 130, a canard 122, a steering structure 140, a support frame 150 and a user platform 160.

The steering structure 140 preferably includes a steering shaft 141 with a top section 142 and a bottom section 143. The properties of the top and bottom sections 142, 143 are substantially the same as those of top and bottom sections 42, 43, respectively, of FIG. 1. The angle, $\alpha$, is formed between linear axes running substantially through the top and bottom sections.

The embodiment of FIG. 2 discloses a canard assembly 122 having a support member 123 that couples to the vertical support 125 for front foil 120. Member 123 preferably has a housing or shell that incorporates spoon face 121 and extends backward therefrom. Member 123 has a volume that is greater that that of a similarly situated support member of FIG. 1. Due to its increased volume, member 123 provides greater front end buoyancy. The shell of member 123 may be formed of metal, fiberglass, carbon fiber or other lightweight and durable material. It may form an air tight volume-and/or house a foam core or other air holding buoyant material.

Platform 160 has a function similar to that of platform 60 of FIG. 1. Platform 160, however, has a larger and substantially unimpeded surface, permitting a user to move laterally about the watercraft. A larger surface area permits a user to do stunts, ride in different positions and even have a second rider.

Platform 160 may also form an air tight volume and/or houses flotation material such as foam to achieve enhanced flotation. The platform shell may be formed of any suitable material such as metal, fiberglass, carbon fiber, plastic or other. Platform 160 may be configured to have sufficient buoyancy to support the weight of a user standing on the platform. This buoyancy, preferably with the buoyancy of member 123, permits a user to start the hydrofoil device from a stopped position in open water, as opposed to having to push/drag that device back to shore or a dock for restart. As seen in FIG. 2, the platform 160 extends laterally for a distance that is at least approximately ⅓ the length of the rear foil.

Figure 3:
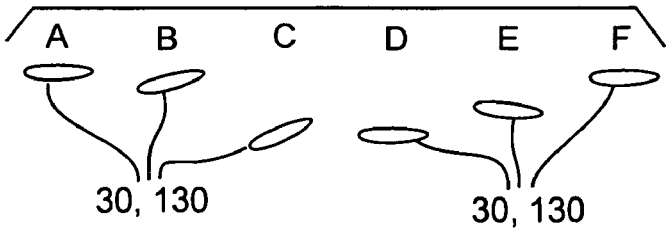
FIG. 3 is diagram illustrating the position of the drive foil cycling through the coast to drive and back to coast positions.

Referring to FIG. 3, a diagram of the relative position of drive foil 30, 130 is shown. Position A is a glide or "steady-state" position as the foil glides through the water. Prior to a leg thrust, a user preferably pushes/thrusts downward on steering handle 41. This force and the geometry of the steering shaft cause the lower section 43,143 to bend, increasing α and causing the leading edge 31 of the drive foil to tip downward (Position B). The user then asserts a leg thrust on platform 60,160 causing tip 31,131 to descend further and causing the entire foil to descend into the water at an angle, pushing the craft forward against the resistance of the water. The position of foil 30,130 at this stage is shown in Position C. As the thrust expires, the retracting elastic force of the lower section 43,143 begins to reduce α, causing the leading edge to begin to rise and the foil to pass through a substantially steady state position, but further submerged than in Position A (Position D). The leading edge then rises slightly (due in part to the surface finding properties of the canard) causing the foil to rise (Position E) and return to its steady-state position (Position F, and Position A), ready for the next downward drive thrust.

Note that while the lower section 43 is preferably movable in a first dimension to facilitate a desired movement of leading edge 31, it is preferably more rigid in a lateral, side to side, dimension to provide adequate steering.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A self-propelled hydrofoil device, comprising:

a front foil;

a rear foil;

a user platform provided above the rear foil;

a steering shaft;

a frame member that couples the steering shaft to the rear foil;

wherein the steering shaft includes a first shaft section and a second shaft section, the first section being coupled to the frame member and being substantially rigid relative to the second section, the second section being coupled through a non-movable coupling joint to the first section at a point below where the frame member couples to the steering shaft;

wherein the second section is flexible relative to the first section such that the second section bends under a downward thrust of a user standing on the platform and then returns to a pre-thrust position; and wherein the first section and the second section are formed as separate items that are fixedly coupled to one another.

2. The device of claim 1, wherein the second section slopes forward to a greater degree than the first section.

3. The device of claim 1, wherein the first section has a best-fit first axis and the second section has a best-fit second axis, the second axis is more horizontally disposed than the first axis.

4. The device of claim 3, wherein the second axis is more horizontally disposed than the first axis by an angle alpha that is substantially between 5 and 60 degrees.

5. The device of claim 4, wherein the angle, alpha is substantially between 10 and 50 degrees.

6. The device of claim 1, wherein the steering shaft includes a third section, the third section being substantially rigid and coupled fixedly and non-movably at one end to the second section and coupled movably at another end to the front foil.

7. The device of claim 1, further comprising a flotation member provided above and fixedly coupled to the front foil, wherein the flotation member has a shell that defines a volume and forms a surface finding spoon at a front end thereof.

8. The device of claim 1, wherein the user platform has a substantially continuous top surface that extends laterally for a distance that is at least ⅓ the length of the rear foil and defines an air tight flotation volume under the top surface.

9. The device of claim 1, wherein the first section is formed of metal and the second section is formed of fiberglass.

10. A self-propelled hydrofoil device, comprising:

A self-propelled hydrofoil device, comprising:

a front foil;

a rear foil;

a user platform provided above the rear foil;

a steering shaft;

a frame member that couples the steering shaft to the rear foil;

wherein the steering shaft includes a first shaft section and a second shaft section, the first section being coupled to the frame member and being substantially rigid relative to the second section, the second section being non-movably coupled to the first section at a point below where the frame member couples to the steering shaft;

wherein the second section is flexible relative to the first section such that the second section bends under a downward thrust of a user standing on the platform and then returns to a pre-thrust position; and wherein the top section and the bottom section are formed integrally of the same material.

11. The device of claim 10, wherein the steering shaft is formed of one of the group of materials including metal, fiberglass and carbon fiber.

12. A self-propelled hydrofoil device, comprising:

a front foil;

a rear foil;

a user platform provided above the rear foil;

a steering shaft having a first section and a second section, the second section being coupled to the first section through a fixed and non-movable coupling joint located towards a bottom end of the first section; and a frame member that couples the steering shaft to the rear foil;

wherein the first section is substantially rigid and has a first principal axis and the second section is flexible, relative to the first section, and has a second principal axis, the second axis being disposed more horizontally than the first axis.

13. The device of claim 12, wherein the second axis is more horizontal than the first axis by an angle alpha that is substantially 5-60 degrees.

14. The device of claim 13, wherein the angle alpha is substantially 10-50 degrees.

15. The device of claim 12, wherein the second section is sufficiently elastic to bend under a downward thrust of a user at the user platform to effectively move the rear foil for driving the device a d then return to a pre-thrust position.

16. The device of claim 12, wherein the second section is formed of one of fiberglass and carbon fiber.

17. The device of claim 12, wherein the steering shaft includes a third section, the third section being substantially rigid and coupled fixedly and non-movably to the second section and coupled movably to the front foil.

18. The device of claim 12, further comprising a flotation member provided above and fixedly coupled to the front foil, wherein the flotation member has a shell that forms a surface finding spoon at a front end thereof.

19. The device of claim 12, wherein the user platform has a substantially continuous top surface that extends laterally for a distance that is at least approximately ⅓ of the length of the rear foil and defines an air tight flotation volume under the top surface.

20. A self-propelled hydrofoil device, comprising:

a front foil;

a rear foil;

a user platform provided above the rear foil;

a steering shaft having a first section and a second section, the second section fixedly and non-movably coupled towards a bottom end of the first section; and a frame member that couples the steering shaft to the rear foil;

wherein the first section is substantially rigid and has a first principal axis and the second section is flexible, relative to the first section, and has a second principal axis, the second axis being disposed more horizontally than the first axis;

wherein the top section and the bottom section are formed integrally of the same material.

* * * * *